US007937869B2

(12) United States Patent
Levin

(10) Patent No.: US 7,937,869 B2
(45) Date of Patent: May 10, 2011

(54) REDUCTION OF MUZZLE JUMP IN FIREARMS

(76) Inventor: Yuri S. Levin, Weston, FL (US)

( * ) Notice: Subject to any disclaimer, the term of this patent is extended or adjusted under 35 U.S.C. 154(b) by 186 days.

(21) Appl. No.: 12/352,201

(22) Filed: Jan. 12, 2009

(65) Prior Publication Data

US 2010/0175548 A1 Jul. 15, 2010

(51) Int. Cl.
*F41A 21/38* (2006.01)

(52) U.S. Cl. ..... 42/1.06; 89/14.3

(58) Field of Classification Search ..... 42/76.01, 42/76.1, 1.06, 77, 78, 79; 89/14.05, 14.3, 89/14.7

See application file for complete search history.

(56) References Cited

U.S. PATENT DOCUMENTS 1,187,218 A * 6/1916 Wister ..... 42/106
1,348,987 A * 8/1920 Fischer ..... 89/1.41
3,521,616 A * 7/1970 Chang et al. ..... 124/67
3,610,222 A * 10/1971 Hartman ..... 124/73
3,617,000 A * 11/1971 Probst et al. ..... 239/706
3,669,087 A * 6/1972 Hamrick et al. ..... 124/74
4,345,578 A * 8/1982 Speer ..... 124/56
H000202 H * 2/1987 Geeter ..... 89/14.05
H000342 H * 10/1987 Geeter ..... 89/14.05
6,167,794 B1 * 1/2001 Kathe ..... 89/14.05
6,324,779 B1 * 12/2001 Tippmann, Jr. ..... 42/76.01
2006/0101697 A1 * 5/2006 Bushnell ..... 42/76.01

* cited by examiner

*Primary Examiner* — Bret Hayes

(57) ABSTRACT

Muzzle jump of projectile-firing guns and weapons systems is significantly reduced by creating a momentum, rotating in the direction opposite to the rotational direction of the momentum causing muzzle jump by redirecting not a gas flow produced by a blast of ammunition but redirecting a projectile traveling through the barrel. The barrel is bent in such a way that curvature of the bend is convex in relation to the support of the gun. The plane of the curvature coincides with the plane of the momentum created by recoil of the gun. Since the projectile possesses significantly greater mass than escaping gases, the contra-momentum is greater than what could be achieved by redirecting a flow of escaping gases so it could be sufficient to completely negate momentum created by recoil force.

5 Claims, 17 Drawing Sheets

Rotation: 0° Director - 0° Housing

Rotation: 30° Director - 75° Housing

Rotation: 60° Director - 60° Housing

Rotation: 90° Director - 45° Housing

Rotation: 120° Director - 30° Housing

Rotation: 180° Director - 0° Housing

REDUCTION OF MUZZLE JUMP IN FIREARMS

The present invention relates to firearms and more particularly to a method and device for reduction of a gun or weapon system jump, resulting from momentum created by the recoil force developed in the process of firing.

BACKGROUND OF THE INVENTION

The disadvantage of known projectile firing guns and weapon systems is that each firing creates a recoil force not directed through the system support. The system support is usually located lower then the line representing the direction of the recoil force. Resulting momentum inevitably causes more or less noticeable movement of the system, for example human firing the pistol or tank firing the gun. Particularly it causes up movement (jump) of the weapon muzzle. This is the undesirable effect of firing since it creates a multitude of problems, for example, a necessity to build a heavier weapon for achieving at least partial inhibition of the jump and a necessity of spending extra time for restoring alignment of the weapon with the target after each shot. In the case of rapid automatic fire produced, for example, by submachine gun, these successive accumulated jumps result in the muzzle movement away from alignment with the target and consequently result in the target missing and the ammunition waste.

There are known devices designed for reducing negative results of the recoil force action, particularly for reducing the jump. Most of these devices create momentum acting in the direction opposite to the momentum causing jump and all of those devices utilize a redirection of a gas flow produced by the blast of ammunition. Most of the USA patents related to this issue are in Class 89/14.3 (U.S. Pat. Nos. 3,665,804; 3,808,943; 4,207,799; 4,374,484; 4,392,413; 4,930,397; 6,269,727; 6,769,346; 7,207,255) and all of the devices described in these patents have the same shortcoming—the force created by gas flow is insufficient for producing significant desired contra-momentum.

Accordingly, it is the objective of the present invention to provide effective improvement over the aforementioned devices that is to significantly reduce muzzle jump.

SUMMARY OF THE INVENTION

The above objective is achieved by creating a momentum, rotating in the direction opposite to the rotational direction of the momentum causing muzzle jump by redirecting not gas flow produced by a blast of ammunition but redirecting a projectile traveling through the barrel. For this purpose in one embodiment a barrel of a gun or of a weapon system is bent in such a way that a longitudinal axis of the bent barrel is lying in a plane, perpendicular to a weapon system supporting surface; while an arc of the longitudinal axis of the bent barrel is convex in relation to the weapon system supporting surface. This plane usually has vertical orientation. In a process of firing, the projectile due to its inertia is supposed to move straight so it is pressing at a wall of the bent barrel and the wall is responding with a centripetal force causing the projectile to deviate from its straight direction due to the bend of the barrel. In accordance to Newton Law this centripetal force is equal to an "anticentripetal" force acting on the barrel in an opposite direction. This "anticentripetal" force creates a momentum rotating in the direction opposite to the rotational direction of the momentum created by the recoil force. In previous art the redirection of the gases is usually performed near an exiting end of the barrel for a maximum utilization of the expanding gases force and for delivering maximum energy to the projectile, at the same time achieving a maximum leverage for creating the maximum contra-momentum. A kinetic energy of the projectile is increasing during its travel through the barrel while a potential energy of the expanding gases is diminishing. Besides, only a portion of the gases could be redirected for producing the contra-momentum since part of them flow through the muzzle in the same direction as the projectile does. Also the mass of the redirected gases is considerably less than the mass of the projectile. For all those reasons previous art is not capable to significantly suppress the muzzle jump. In consideration of all of the above, utilization of proposed embodiment would provide for significantly more efficient muzzle jump reduction.

A radius of the barrel's bend is specific to a particular weapon and could be calculated considering weight and geometry of the weapon (position of the support and its distance to the barrel in the direction to the center of the barrel's bend), and considering weight and speed of the projectile, traveling through the barrel.

In another embodiment the barrel of the weapon is bent with small radius of the bend and comprises two straight lengths before and after the bend.

To provide for the possibility of utilizing this invention on existing guns one more embodiment is conceived as attachable device. This device comprises a housing having elongated cylindrical or conic mounting opening at its back end for attaching the device to a cylindrical or conic front end of the particular gun's barrel with the possibility of rotation in relation to this barrel's axis, housing having at its front end an elongated cylindrical opening with it's axes skewed in relation to the axes of the housing's back opening, and a cylindrical director inserted with the possibility of rotation in the elongated cylindrical opening of this housing's front end, the cylindrical director having an elongated passage, skewed in relation to it's outside cylindrical surface, that passage having a cone opening at a projectile entrance end. The device also has means for securing rotational angle position of the director in relation to the housing and means for securing rotational angle position of the housing in relation to the weapon's barrel.

Turning the director at a certain angle in the housing allows to change the angle between elongated axes of the housing and of the director. Since the axis of the housing mounting opening coincides with the axis of the barrel that action is changing the angle between elongated axes of the director and of the barrel. This way the angle can be changed from 0° to a maximum. A magnitude of the maximum angle change depends on a magnitude of the skewing angles of the cylindrical openings in the housing and in the director.

Turning the housing on the barrel and securing it in a new position allows a setting up of a resulting curvature plain in such a way (usually vertically) that it would coincide with the weapon system supporting point or it would be perpendicular to the system supporting surface, which means that the resulting momentum would be positioned in the same plane as the momentum causing jump of the barrel (as it was mentioned earlier, resulting momentum has the rotational direction opposite to the rotational direction of the momentum causing jump).

A specific modification of the mounting means of the device would allow attaching it to a specific gun barrel, and adjustment of the angle between elongated axes of the housing and of the director would allow providing an appropriate contra-momentum for a specific gun. This would make it possible to use the same principal design for the multitude of the weapon systems.

It is understood that the proposed design would cause extensive wear of the barrel in case of the first embodiment or of the attachment director in case of the preferred embodiment. For this reason implementation of the attachable device may have the most practical sense because a replacement of worn-out director of the attachment is a simple enough and more cost effective operation than replacement of the worn-out barrel which would require spending significantly more money on parts and labor.

It is also obvious that implementation of proposed design may require realignment of the weapon's aiming system which is achievable by known means and for that reason is not a subject of this invention.

DETAILED DESCRIPTION OF THE INVENTION

Figure 1:
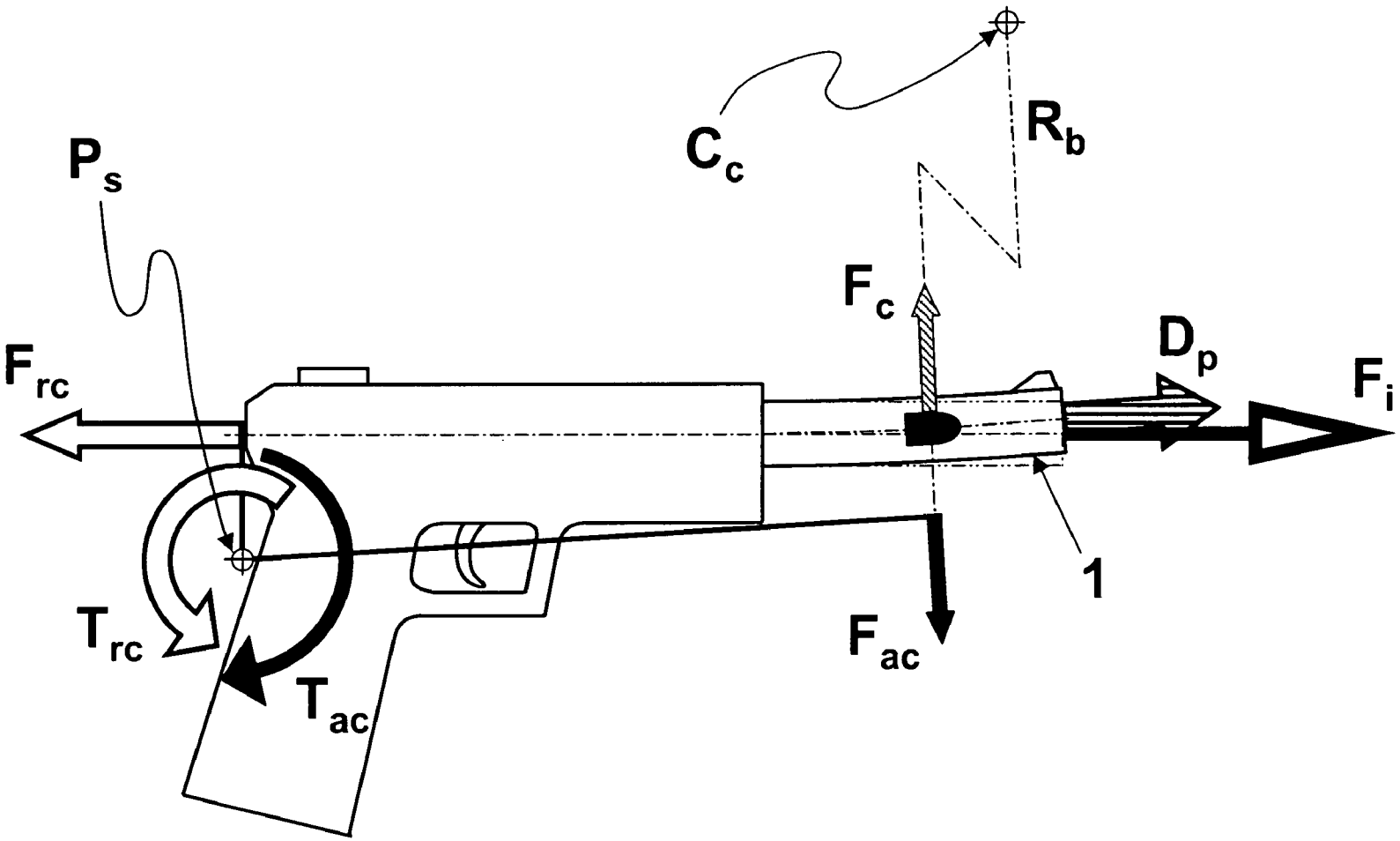
FIG. 1 is a schematic illustration of the forces and momentums occurring during firing a gun.
Figure 2:
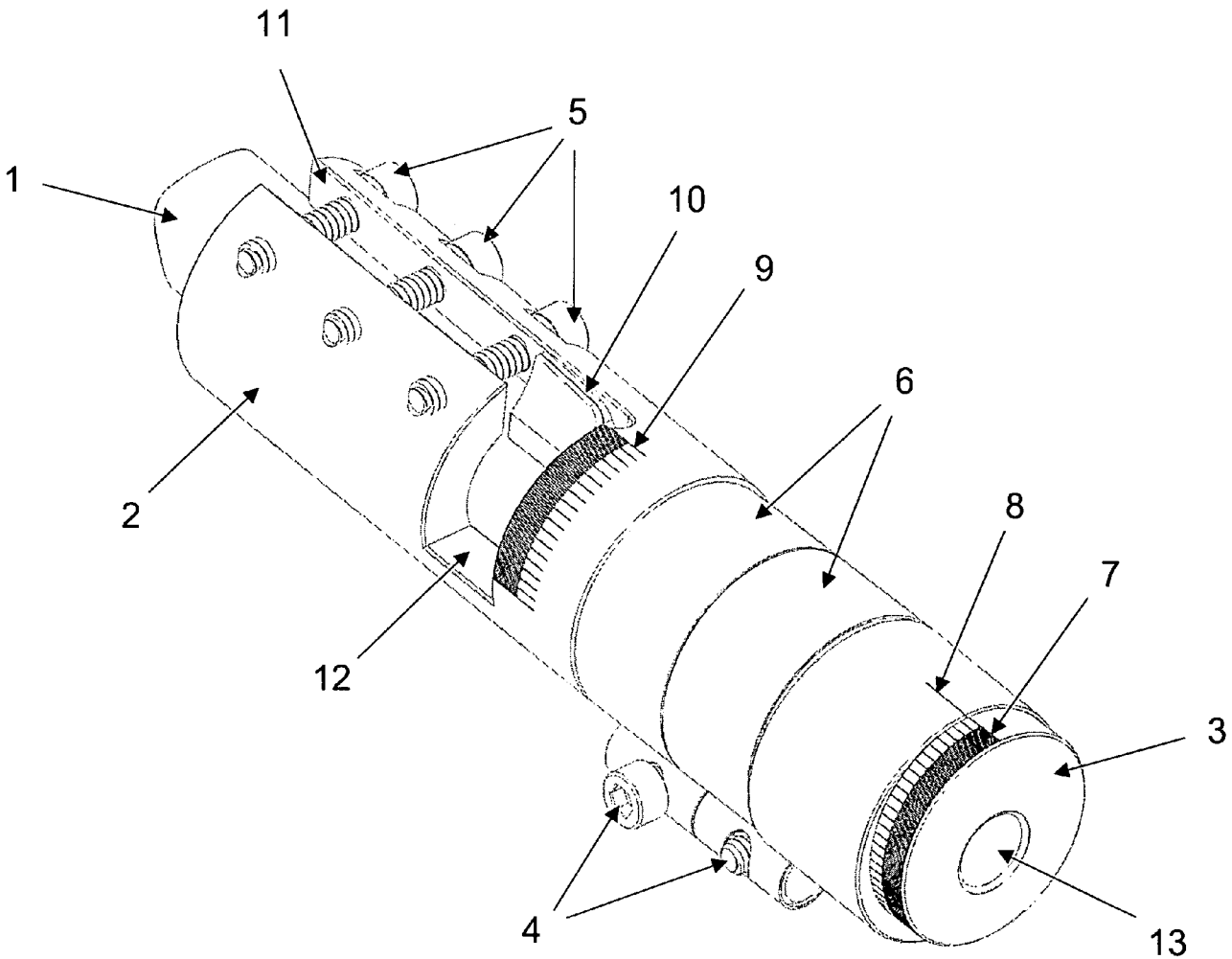
FIG. 2 is isometric view of the device.
Figure 3:
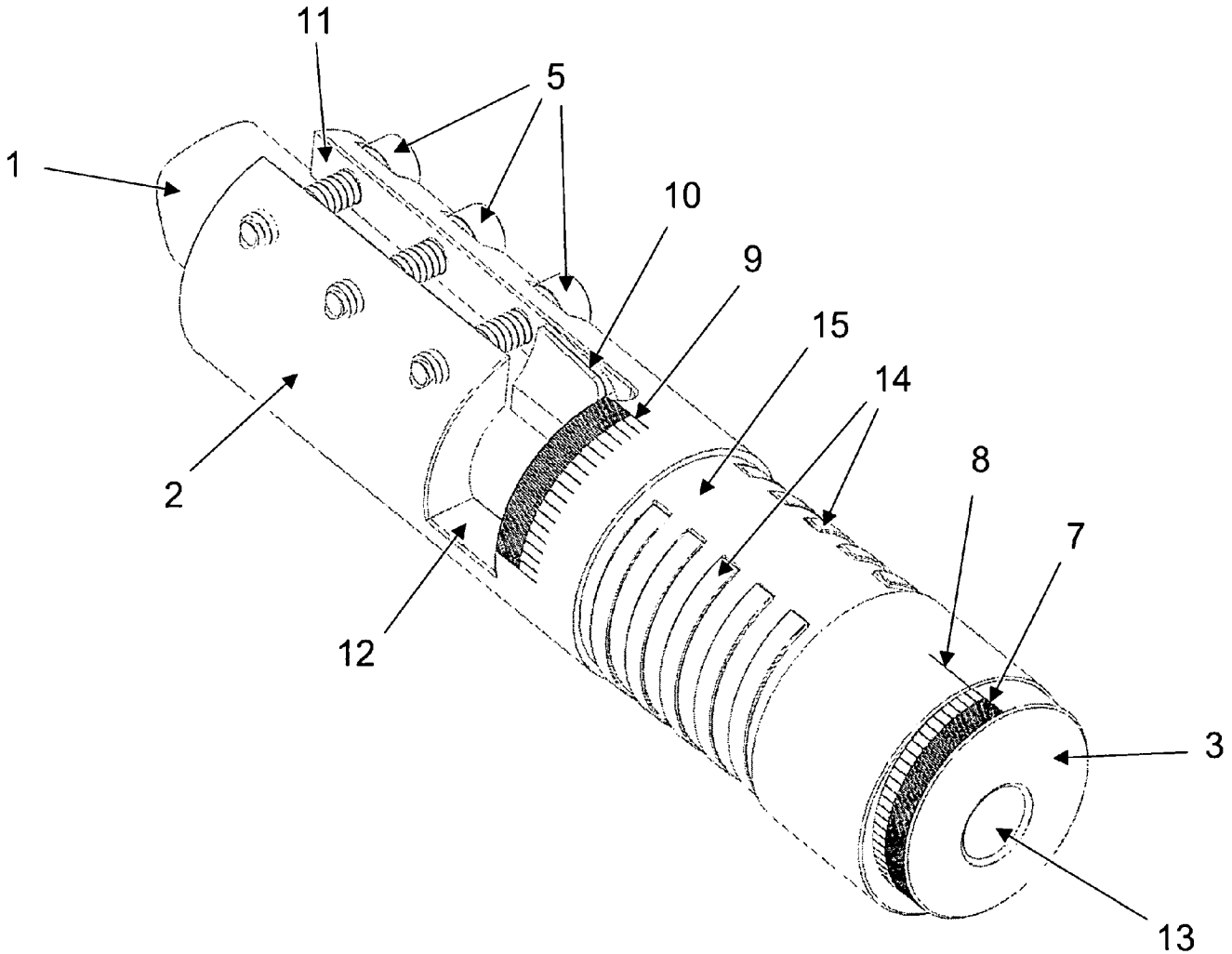
FIG. 3 is the same view with director's securing rotation means removed for showing retaining keys.
Figure 4:
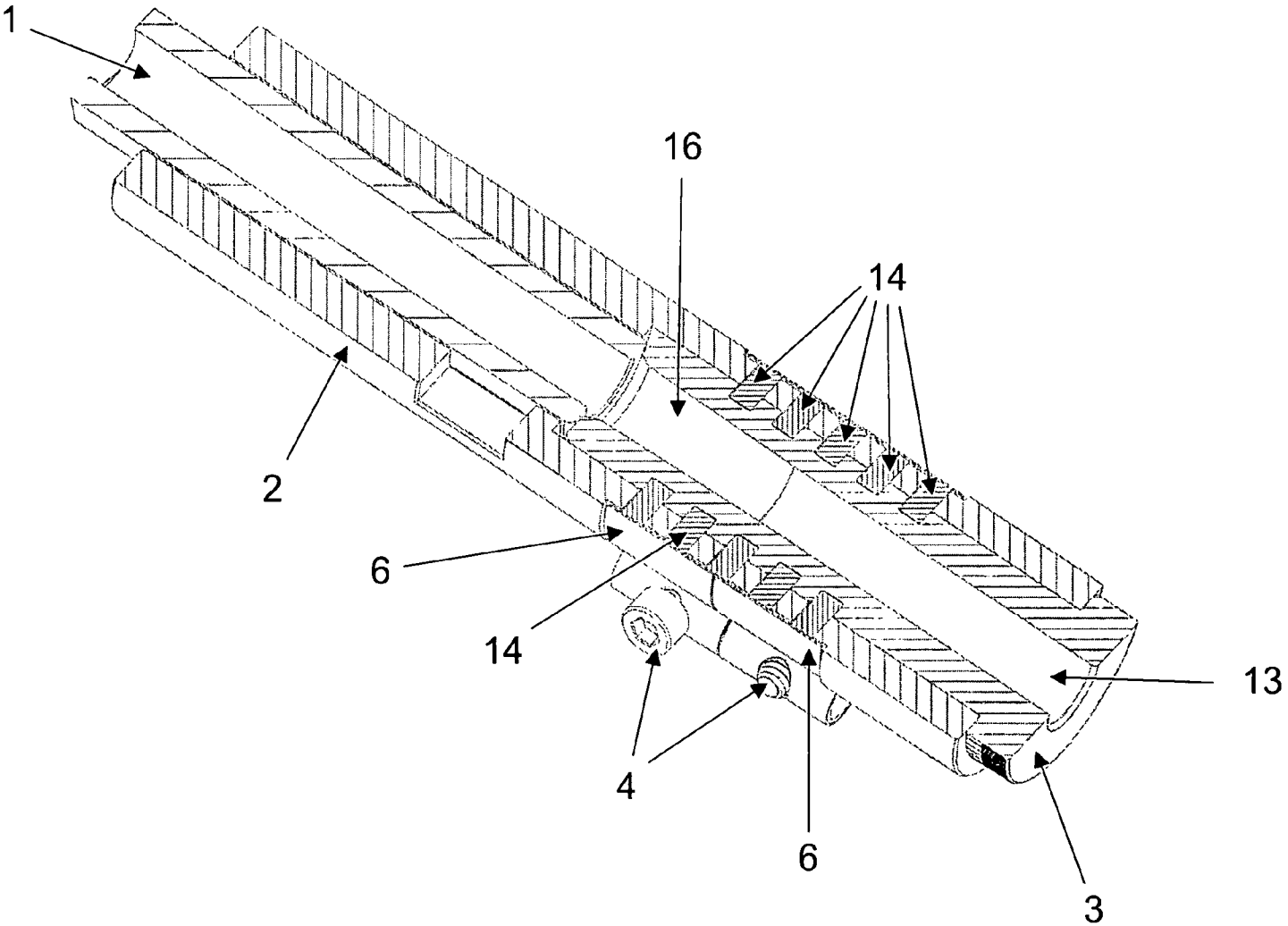
FIG. 4 is a longitudinal horizontal sectional view of the device.
Figure 5:
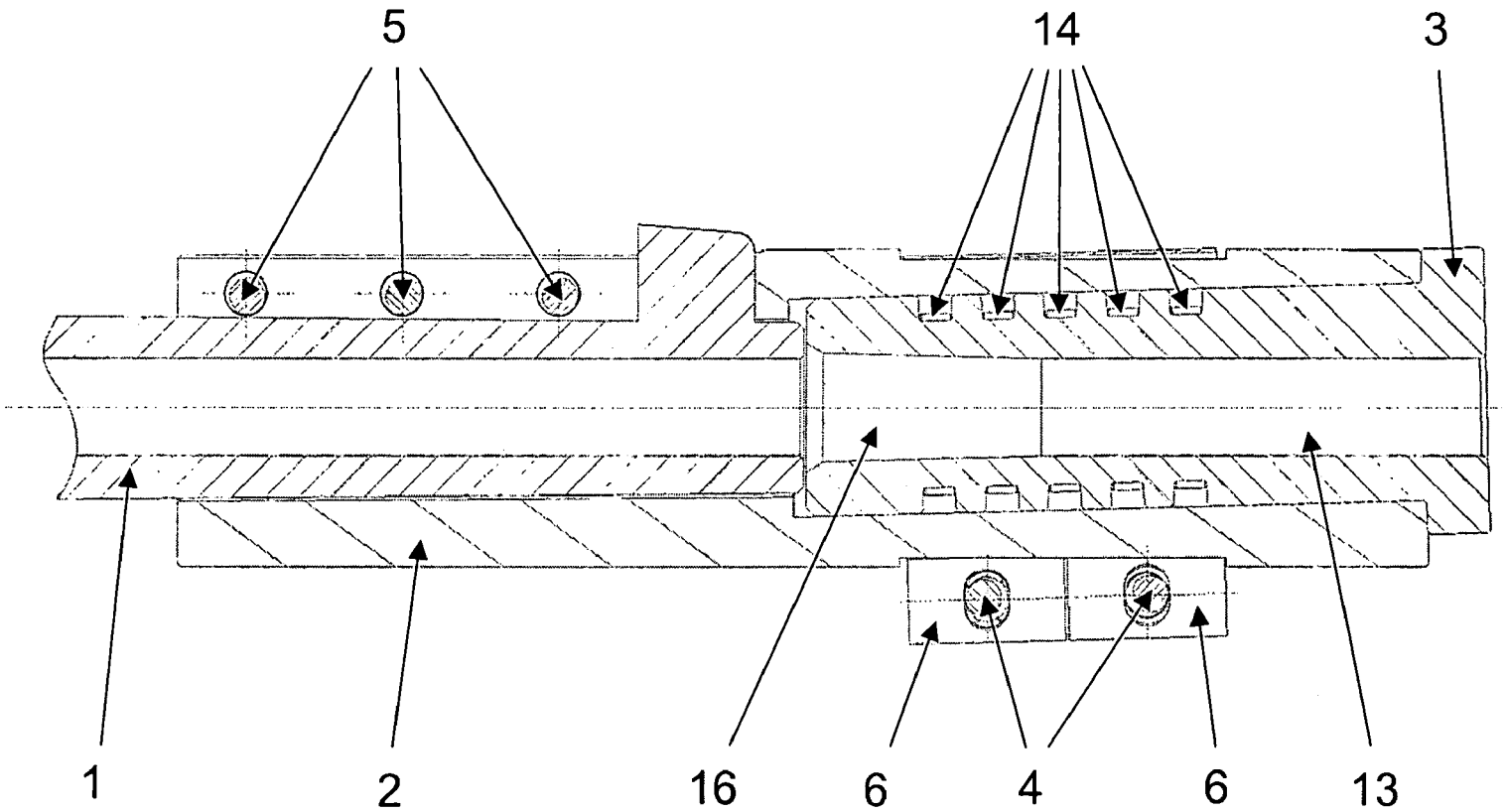
FIG. 5 is a longitudinal vertical sectional view of the device with adjustable bend angle set up to the minimum (0°)
Figure 6:
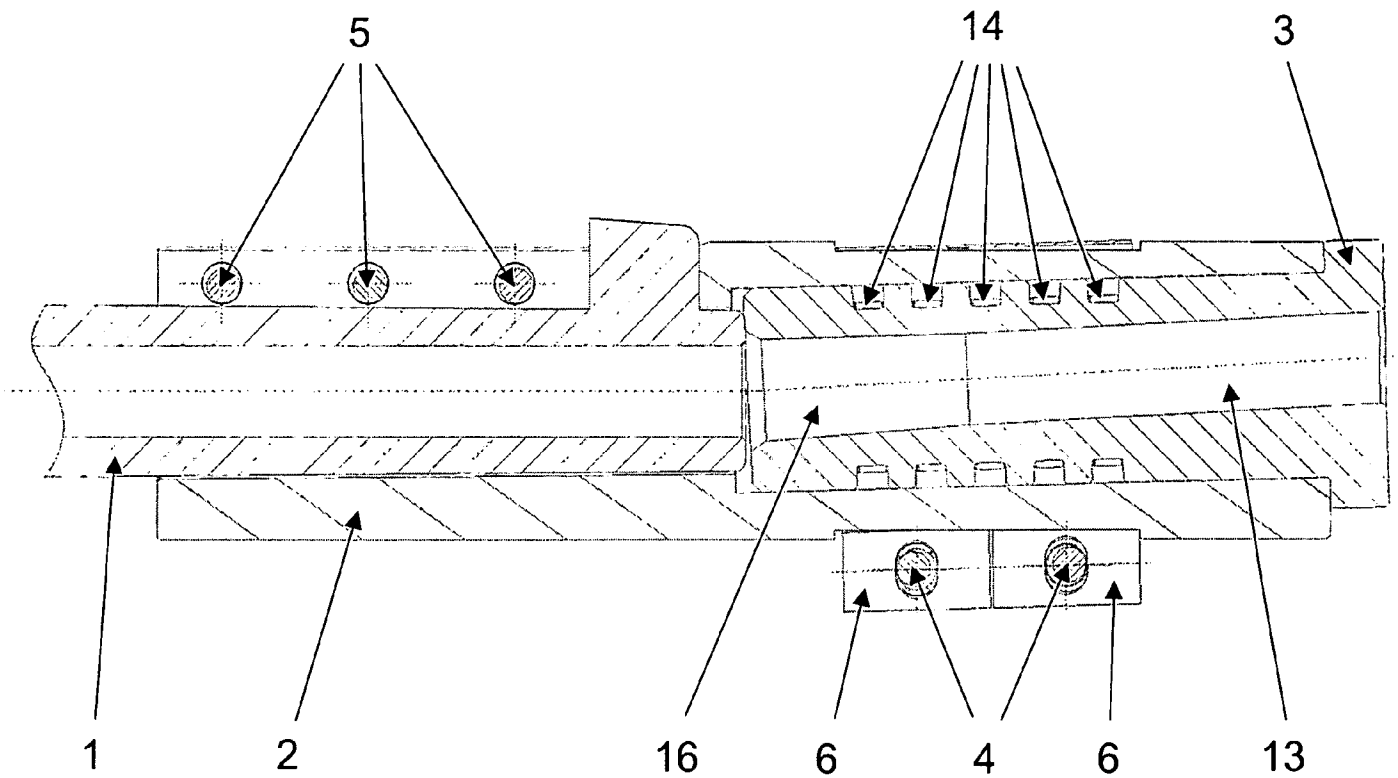
FIG. 6 is a longitudinal vertical sectional view of the device with adjustable bend angle set up to the maximum (for this particular choice of skewing angles)

With reference now to the FIG. 1 of the drawings in preferred embodiment a barrel 1 of the weapon is bent with radius $R_b$ in such a way that the longitudinal arched axis of the barrel 1 is laying in the plane coinciding with the weapon system's point of support $P_s$ or it is perpendicular to a weapon system supporting surface (not shown), while the curvature of the longitudinal arched axis of the barrel 1 is convex in relation to the weapon system point of support $P_s$ or to the weapon system supporting surface (not shown), said plane also coincides with a centre $C_c$ of said curvature, while the longitudinal arched axis of the barrel 1 is laying in said plane between the centre $C_c$ of the curvature and the weapon system point of support $P_s$ or the weapon system supporting surface (not shown). This said plane is usually vertically oriented and in our case is parallel to the drawing paper plane. In the process of firing, the projectile due to its inertia force $F_i$ is pressing at the wall of the bent barrel and the wall is responding with centripetal force $F_c$ causing the projectile to change its direction to $D_p$. In accordance to Newton Law this centripetal force $F_c$ is producing equal opposite "anticentripetal" force $F_{ac}$ applied to the barrel, which creates momentum $T_{ac}$ acting in the direction opposite to the direction of the momentum $T_{rc}$ created by the recoil force $F_{rc}$.

The magnitude of the radius $R_b$ providing a momentum sufficient to compensate the jump of the barrel 1 depends on the mass and geometry of the weapon system and also depends on mass and speed of the projectile leaving the barrel 1.

Figure 7:
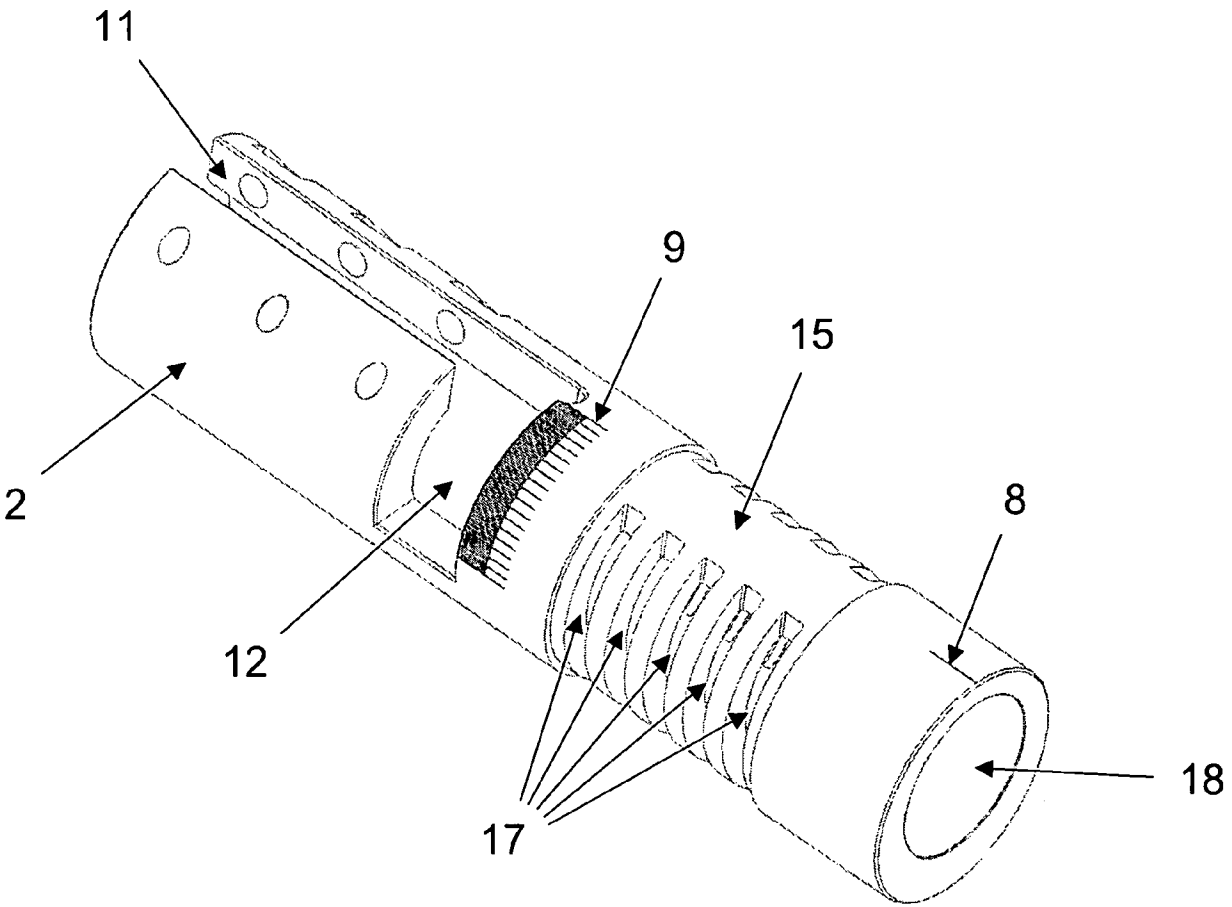
FIG. 7 is isometric view of the housing.
Figure 8:
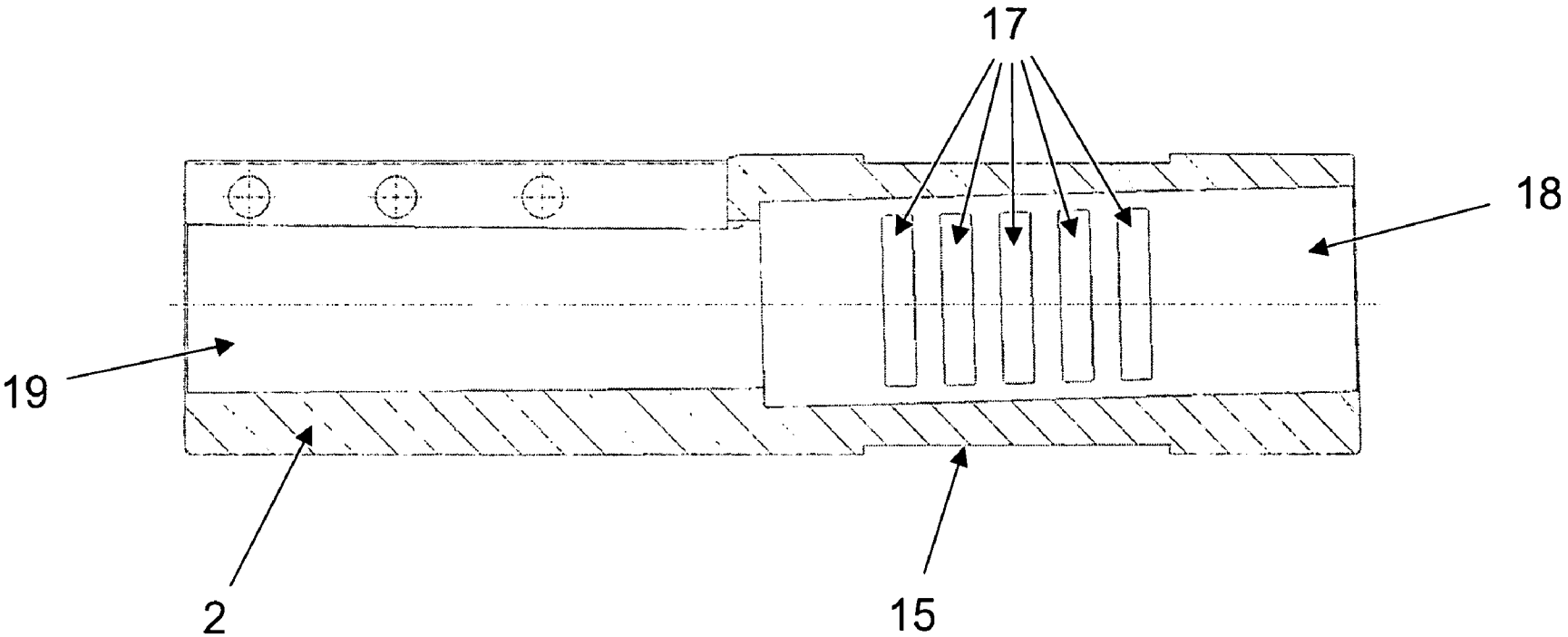
FIG. 8 is longitudinal sectional view of the housing.
Figure 9:
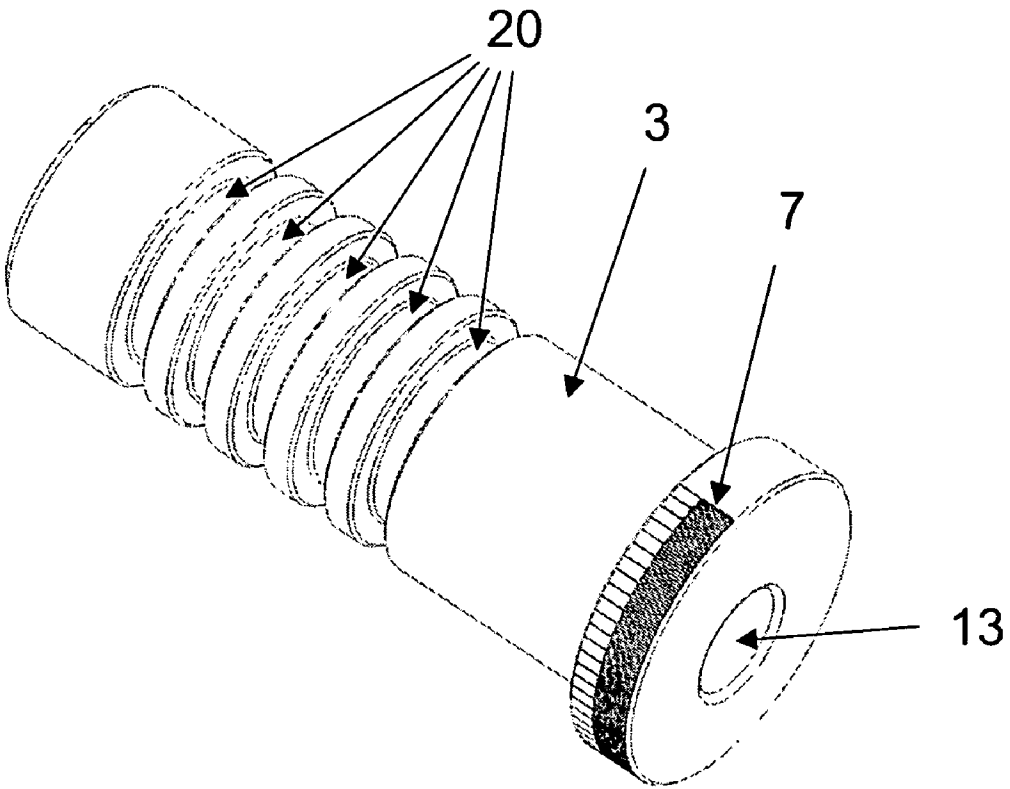
FIG. 9 is isometric view of the director.
Figure 10:
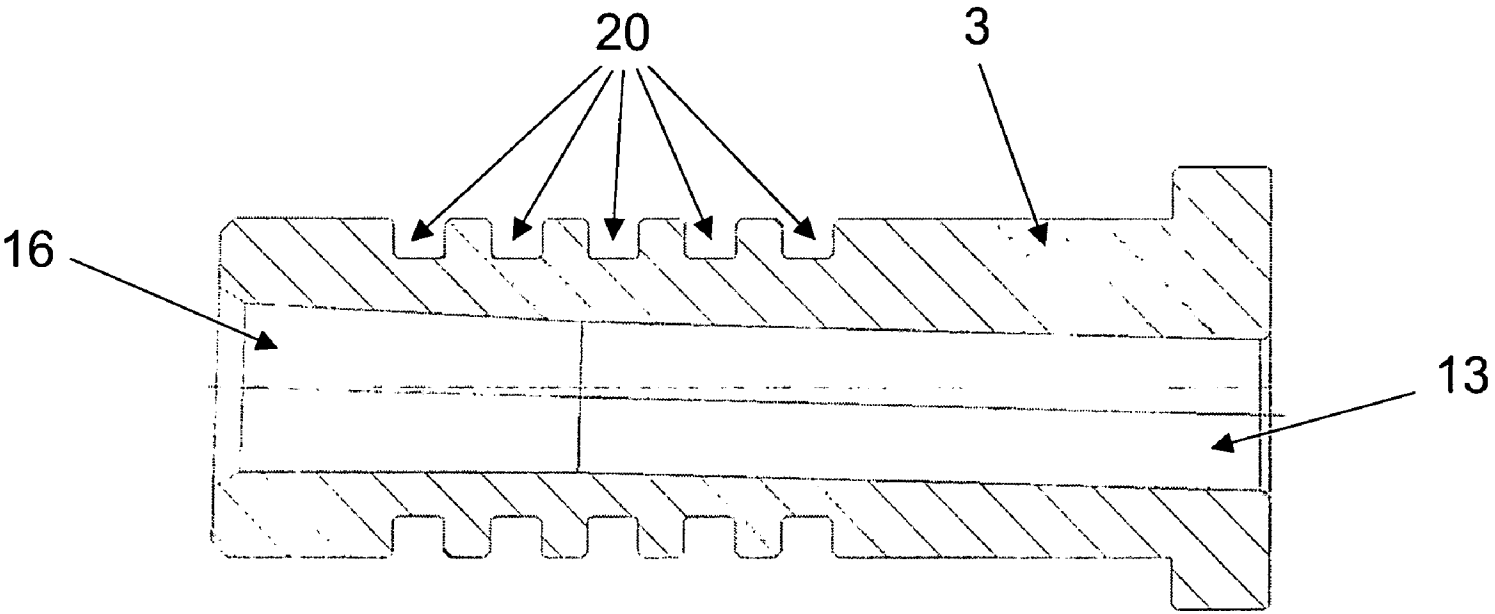
FIG. 10 is longitudinal sectional view of the director.
Figure 11:
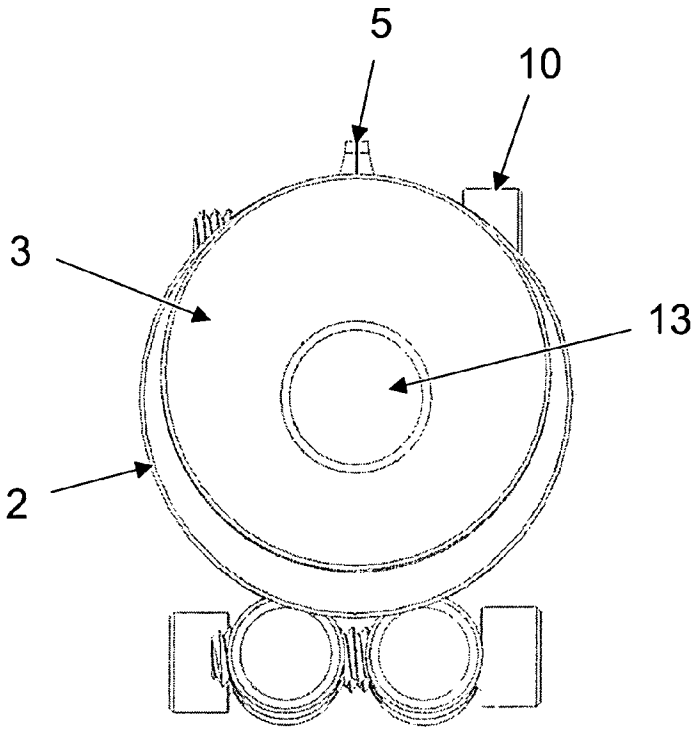
FIG. 11-17 are front views of the device with adjustable bend angle set up to the intermediate positions with 30° increment (for illustration).
Figure 12:
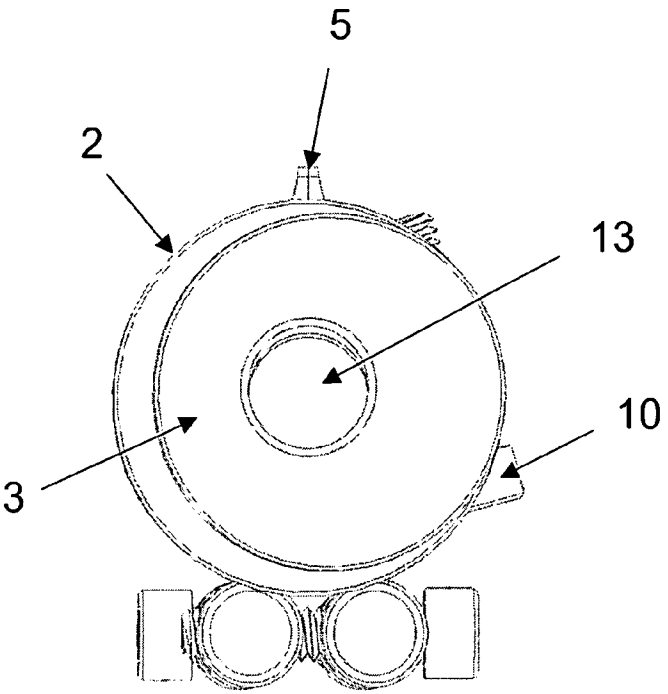
Figure 13:
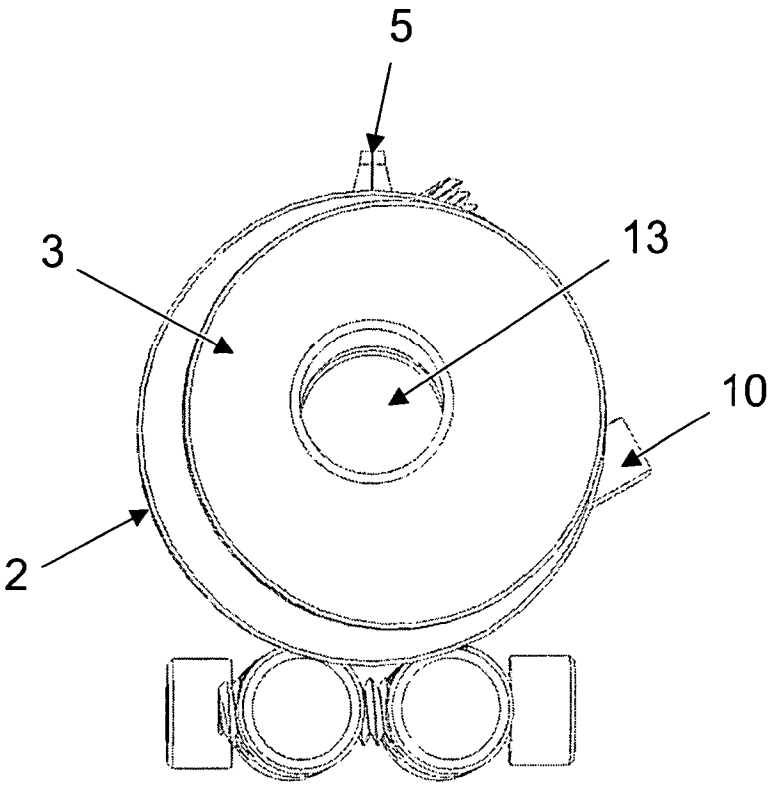
Figure 14:
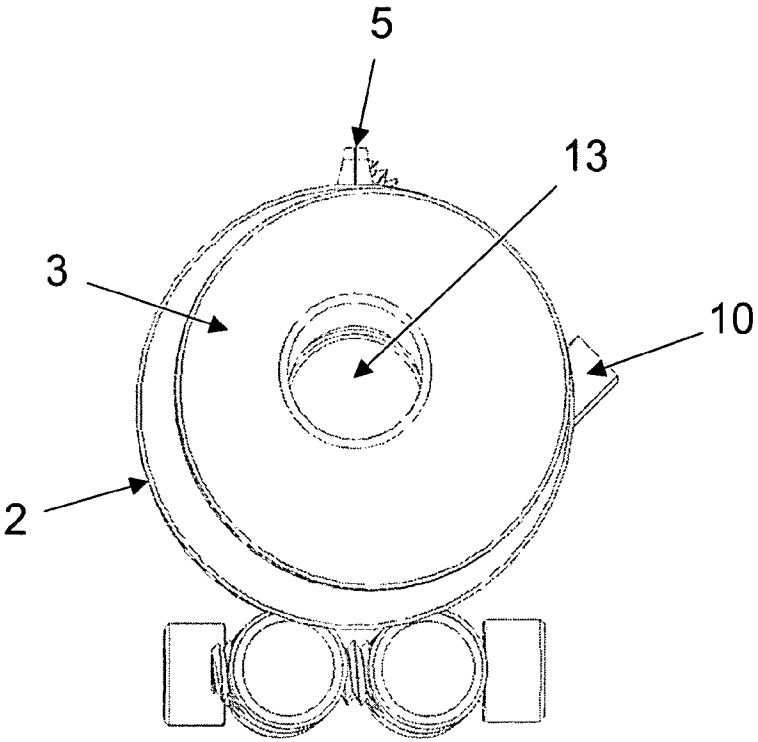
Figure 15:
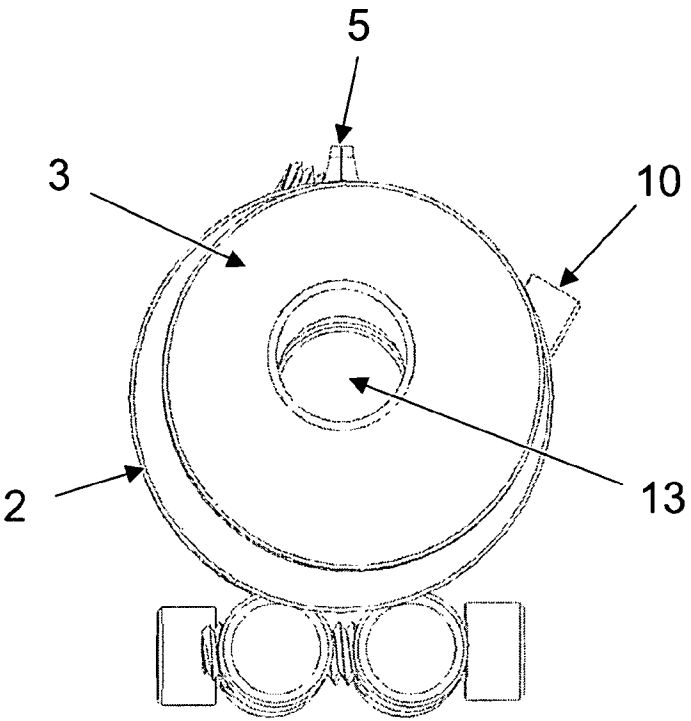
Figure 16:
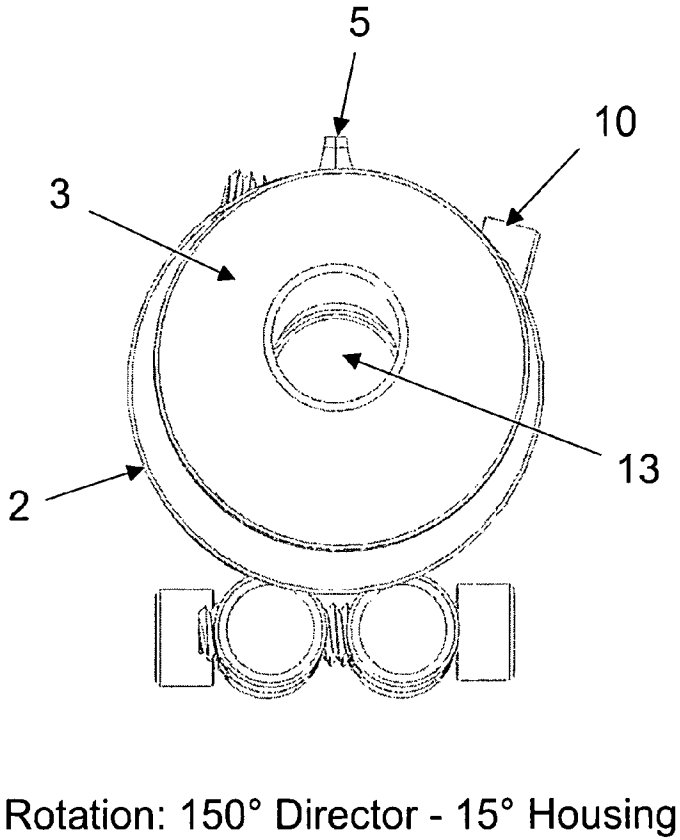
Figure 17:
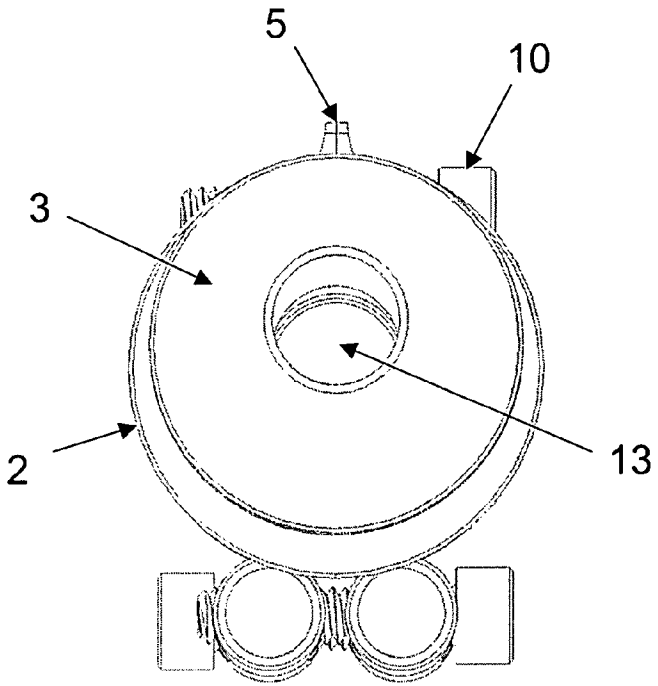

For the practical purpose this method of jump compensation can be implemented using the device shown on the FIG. 2-6 and FIG. 11-17, comprising a housing 2 having in its rear end cylindrical hole 19 (FIG. 8) with a slot 11 (FIG. 7) provided for clamping the housing 2 on the barrel 1 at any chosen angle position in relation to a longitudinal axis of the barrel 1. Clamping is performed by tightening clamp screws 5. Cut-out 12 of the housing 2 is provided to accommodate front sight 10 of the barrel 1 when housing 2 is to be turned around the barrel 1. A dial 9 is placed next to the edge of the cut-out 12. A mark line on the front sight 10 and dial 9 are used for setting-up the turn angle of the housing 2 in relation to the longitudinal axis of the barrel 1.

The front end of the housing 2 has skewed cylindrical hole 18 (as best seen on FIG. 8) for a placement of a director 3. Ten slots 17 are cut in the housing 2 for inserting retaining keys 14 and five grooves 20 are cut on outside surface of the director 3 for retaining the director 3 with the possibility of rotation inside the hole 18 of the housing 2.

Director 3 has skewed cylindrical passage 13 for the projectile travel. A cone 14 is made at the back end of the director 3 to provide for an unimpeded entrance of the projectile coming from the barrel 1 and into the passage 13 of the director 3. A mark line 8 is placed next to the front flange of the housing 2 and a dial 7 is placed on a cylindrical surface of the director 3 front flange for setting-up proper desirable turn angle of the director 3 in relation to the longitudinal axis of the skewed cylindrical hole 18 of the housing 2.

Clamps 6 are placed in an undercut 15 of the housing 2 to provide for a possibility to lock director 3 in chosen angle position in relation to the longitudinal axis of the skewed cylindrical hole 18 of the housing 2. When screws 4 of said clamps 6 are tightened the contracting clamps 6 exert force on keys 14 squeezing director 3 and locking it in relation to the housing 2.

A described device allows a smooth change of the angle between axes of the skewed holes of the barrel 1 and of the director 3 from 0° to a maximum degree which is the sum of the skewing angles of the passage 13 axis in the director 3 and of the hole 18 axis in the housing 2.

Rotating the director 3 in the housing 2 is not only changing the angle between the axes as described above but also rotates a plane where these both axes are located. This action takes said axes plane out of alignment with the plane comprising the weapon system point of support $P_s$ or with the plane which is perpendicular to a weapon system supporting surface (not shown). Rotating the whole device back to a proper angle in relation to the barrel 1 (usually to a vertical position) allows to align the axes plane with the plane comprising the weapon system point of support $P_s$ or to align the axes plane with the plane which is perpendicular to a weapon system supporting surface (not shown). This way contra-momentum created by a projectile traveling through the passage 13 of the director 3 would most effectively work against momentum created by recoil.

In the proposed design for providing vertical position for both—jump momentum plane and contra-momentum plane, rotation angle of the device (in direction opposite to rotation of director 3) is equal to:

$$A_{DV°}=(180°-A_{DR°})/2$$

Where:

$A_{DV°}$—rotation angle of the device, $A_{DR°}$—rotation angle of the director 3.

The invention claimed is:

1. A method of reducing a muzzle jump of a gun comprising the following steps:

providing a barrel of the gun with an additional barrel at a non-zero angle with respect to a longitudinal axis of the barrel of the gun to thereby provide a momentum rotating in a direction opposite to a rotational direction of a momentum causing the muzzle jump by redirecting a projectile traveling through the barrel of the gun and through the additional barrel in a process of firing, and maintaining the additional barrel fixed during the process of firing;

providing a placement of said additional barrel in a plane perpendicular to an axis of recoil momentum rotation.

2. The method according to claim 1, wherein:

the non-zero angle is specific to a particular gun.

3. The method according to claim 1, wherein:

the barrel comprises a straight section;

the additional barrel comprises a straight section; and, the non-zero angle is between the barrels.

4. The method according to claim 3, wherein: the non-zero angle is specific to a particular gun.

5. A projectile firing gun comprising:

a barrel having a longitudinal axis;

an additional barrel having a longitudinal axis and disposed at an a non-zero angle at a muzzle end of said barrel, the additional barrel tapering down to a bore diameter at one end;

wherein said barrels are arranged such that the axes are located in a plane perpendicular to an axis of recoil momentum rotation of the gun and such that the bore diameter is disposed away from a muzzle end of the barrel;

a housing attached to said barrel, said housing having at a front end with a skewed longitudinal cylindrical hole for locating the additional barrel, said housing further including means for rotatably mounting said housing on said barrel in relation to the longitudinal axis of said barrel, said means for rotatably mounting located in a rear end of said housing;

means for setting an angle of rotation of the means for rotatably mounting; and, means for locking said housing in a set position;

means for rotatably retaining the additional barrel within the skewed hole;

means for setting the non-zero angle;

means for locking the additional barrel in a set position;

means for locating holding keys, said keys being rotatably retained the skewed hole; and, wherein the additional barrel further comprises means for setting an angle of rotation.

* * * * *